US011773699B2

(12) United States Patent
Sherman et al.

(10) Patent No.: US 11,773,699 B2
(45) Date of Patent: Oct. 3, 2023

(54) POWERTRAIN FOR WELLSITE OPERATIONS AND METHOD

(71) Applicants: David Sherman, Calgary (CA); Craig Talbot, Calgary (CA)

(72) Inventors: David Sherman, Calgary (CA); Craig Talbot, Calgary (CA)

( * ) Notice: Subject to any disclaimer, the term of this patent is extended or adjusted under 35 U.S.C. 154(b) by 421 days.

(21) Appl. No.: 17/051,411

(22) PCT Filed: May 1, 2019

(86) PCT No.: PCT/CA2019/050575
§ 371 (c)(1),
(2) Date: Oct. 28, 2020

(87) PCT Pub. No.: WO2019/210417
PCT Pub. Date: Nov. 7, 2019

(65) Prior Publication Data

US 2021/0310341 A1 Oct. 7, 2021

Related U.S. Application Data

(60) Provisional application No. 62/664,943, filed on May 1, 2018.

(51) Int. Cl.
*F04B 17/03* (2006.01)
*E21B 43/12* (2006.01)
(Continued)

(52) U.S. Cl.
CPC ..... *E21B 43/12* (2013.01); *E21B 43/267* (2013.01); *F04B 17/03* (2013.01); *F04B 47/00* (2013.01); *F04D 13/068* (2013.01)

(58) Field of Classification Search
CPC ..... E21B 43/26; F04D 13/06; F04D 13/068; F04B 17/03
See application file for complete search history.

(56) References Cited

U.S. PATENT DOCUMENTS 8,648,495 B2 * 2/2014 Chou ..... H02J 7/35 307/64
9,893,500 B2 * 2/2018 Oehring ..... F04B 35/04
(Continued)

FOREIGN PATENT DOCUMENTS

CA 2935772 8/2015
CA 2964593 10/2017

OTHER PUBLICATIONS

International Search Report received in corresponding PCT Application No. PCT/CA2019/050575, dated Jul. 10, 2019, 5 pages.
(Continued)

*Primary Examiner* — Kenneth L Thompson
(74) *Attorney, Agent, or Firm* — PARLEE MCLAWS, LLP

(57) ABSTRACT

A powertrain for powering wellsite pumping operations includes a power source for producing energy, a power bank, electric motors coupled to pumps, and a power management system. The power source can be a prime mover coupled to a generator, the prime mover sized for supply up to the average power demand of the pumping operation, and the power bank is sized to supply up to at least the difference between the peak and average power demand of the pumping operation, thereby providing a load levelling means to satisfy peak demand of the operation. The power management system manages the direction of current flow, state of charge of the power bank, and power source operation to provide least fuel consumption while meeting the power demand of the pumping operation.

19 Claims, 13 Drawing Sheets

(51) Int. Cl.

| | |
|---|---|
| ***E21B 43/267*** | (2006.01) |
| ***F04B 47/00*** | (2006.01) |
| *F04D 13/06* | (2006.01) |

(56) References Cited

U.S. PATENT DOCUMENTS

| | | | | |
|---|---|---|---|---|
| 10,008,880 | B2 * | 6/2018 | Vicknair | H02J 13/00034 |
| 10,530,290 | B2 * | 1/2020 | Janik | G06Q 10/06312 |
| 10,559,957 | B2 * | 2/2020 | Pedersen | H02J 3/381 |
| 10,577,910 | B2 * | 3/2020 | Stephenson | F04B 17/03 |
| 10,935,948 | B2 * | 3/2021 | Morin | H02J 7/00038 |
| 11,114,857 | B2 * | 9/2021 | Hinderliter | E21B 43/26 |
| 11,421,673 | B2 * | 8/2022 | Coskrey | F04B 17/06 |
| 2011/0290483 | A1 * | 12/2011 | Zornes | E21B 41/0085 166/227 |
| 2016/0032703 | A1 | 2/2016 | Broussard et al. | |
| 2018/0284817 | A1 * | 10/2018 | Cook | G05D 7/0664 |

OTHER PUBLICATIONS

Written Opinion received in corresponding PCT Application No. PCT/CA2019/050575, dated Aug. 7, 2019, 4 pages.

* cited by examiner

POWERTRAIN FOR WELLSITE OPERATIONS AND METHOD

CROSS-REFERENCE TO RELATED APPLICATIONS

This application claims the benefit of U.S. Provisional Patent application Ser. No. 62/664,943, filed May 1, 2018, the entirety of which is incorporated herein by reference.

FIELD

Embodiments herein relate to pumping operations for oil and gas wells. In particular, embodiments herein relate to an improved powertrain incorporating an energy storage medium for powering wellsite pumping operations.

BACKGROUND

Many oil and gas wells require stimulation in order to increase the production of hydrocarbons from an earth formation. Stimulation is typically accomplished using the process of hydraulic fracturing, which injects water, sand, and other chemicals from surface into a wellbore in communication with the formation to create and maintain fractures in the formation rock, and thus pathways for the oil and gas to flow from the formation to the wellbore and subsequently to the surface to be collected and transported.

Traditionally, water, sand, and other ingredients to be injected into the formation are blended at surface and then pumped downhole as a slurry. The pumps used are typically plunger style-pumps. Other injection methods are sometimes used, where a concentrated sand slurry is pumped by plunger style pumps, while clean water is pumped by pumps typically used in water pumping applications, and the two pressurized streams are blended together at the desired density before being transported downhole. Other wellbore operations such as acidizing, cementing, cleaning, and displacing are also performed using pumps to pump a fluid downhole in a manner similar to that used for wellbore stimulation.

Typically, a plurality of pumps is used to pump the slurry downhole, each pump mechanically driven by a prime mover such as a diesel engine through a multispeed gearbox/transmission to provide an appropriate level of gear reduction to match the desired pumping rate and pressure with the available power the diesel engine can produce.

Wellbore pumping operations typically start at a minimal "feed rate" which is gradually increased over time, resulting in a peak pumping power for the particular pressure pumping operation. Other pumping factors such as geological stresses, fluid viscosity, proppant, downhole duning and sweeping, dendritic branch development, spurt losses, and fluid density also affect pumping power requirements. The resulting power requirement over the course of a pumping operation can be plotted as a hydraulic horsepower profile, hydraulic horsepower (HHP) being a measurement of how much power is required to pump a fluid.

At the beginning of a wellbore stimulation pumping operation, the pump ramps up the volumetric flowrate and pressure until there is formation breakdown, which is the point where fractures in the rock initiate. Once fracturing is initiated, substantially less energy is required to propagate the fractures. Thus, there is a large, or peak, HHP hydraulic horsepower demand to initiate a fracture, which decreases rapidly once fracturing is initiated. Additionally, downhole stimulations result in increased dendritic branching, which requires the stimulation pressure pumping rate to be gradually increased in order to continue to develop the fracture network.

Prior to commencing pressure pumping operations, a job design is done based on known conditions from neighbouring wells and geologic conditions. From this known data, the maximum and average HHP requirements can be anticipated relatively accurately. The number of proposed stages of the fracturing operation and the amount of proppant desired to be placed are also determined before the beginning of pumping operations.

Typical HHP profiles, over time for stimulations of less than 500 kg/m3 result in a peak-to-average HHP demand ratio of about 1.5 (see FIG. 4B). High sand concentration pumping operations with aggressive sand ramps greater than 1000 kg/m3 can result in a peak-to-average HHP ratio of greater than 3 (see FIG. 4C). Typically, HHP ratios range from 1.5 to 3. However, it is necessary to have sufficient power on site to meet the expected peak hydraulic horsepower demand, plus a contingency. This can result in the onsite available HHP being 2-4 times the average HHP that is needed for the operation. This is inefficient, as significant capital is required to purchase the diesel engines to supply the peak HHP, such peak-demand engines being quite large and heavy, making transport difficult and costly, and substantial manpower is required to commission the engines for operation.

Further, the use of diesel engines as prime movers is disadvantageous, due to their relatively high fuel consumption and emissions, driven by the necessity for the engines to be oversized to be capable of providing peak power only periodically for fracture initiation. Such sizing means that the diesel engines are idling for extended times when peak power is not required, with consequent inefficiencies.

A further disadvantage of diesel engine-powered pumping operations is that diesel engines are typically coupled to the pump through a multispeed hydraulically controlled gearbox. The gearbox can overheat if the cooling system is not well maintained, and thus limits the rate at which water and slurry can be pumped into the wellbore. Maintaining the gearbox in good condition is extremely difficult in oilfield operations, as such environments are often dirty and dusty. Thus, the gearbox is often a major limiting factor in how much power may be output by the diesel engine, and therefore the available HHP for the pumping operation.

Gas turbine prime movers, using natural gas as fuel, can reduce CO2 and NOx emissions by approximately 30-60% compared to conventional diesel engines. However, gas turbines sized for generating sufficient power for wellbore pumping operations (i.e. at least up to peak HHP) typically comprise three or more semi-truck loads of equipment, require a large capacity crane onsite to assemble all the components into an operable unit, and necessitate at least a week of setup time. In comparison, conventional diesel powered fracturing equipment can be driven onto site on a single semi-truck and operating in a few hours.

There also exist "bi-fuel" diesel engines that are capable of operating on part natural gas, part diesel fuel. However, such bi-fuel diesel engines have greater mechanical complexity so as to provide two types of fuel to the engine, with two separate fuel systems. Other disadvantages are that the engine must idle on pure diesel fuel and, when in bi-fuel mode and under power, only about 40% of the diesel fuel can be substituted by natural gas, thus limiting the improvement in fuel consumption and emissions. There is also a phenomenon called "methane slip", where a certain portion of the natural gas is not burned and simply passes through the engine, thus increasing greenhouse gas emissions. Overall, experience has shown that the cost savings associated with operating bi-fuel engines is negligible as compared to conventional diesel engines.

There is a need for a powertrain for wellbore pumping operations that is capable of meeting at least the peak HHP demand of such operations while providing increased fuel efficiency and a reduction in emissions, capital expenditure, manpower requirements, and space needed to accommodate the powertrain equipment, and further to maintain the ease of setup and short commission of conventional diesel-powered equipment.

SUMMARY

Generally, a powertrain is provided for powering wellsite pumping operations including a power source for producing energy onsite that is operated at peak efficiency, but not necessarily at the peak power demand of the operations. In addition, for meeting peak power demands, energy storage such as a power bank is provided to make up the power shortfall of the power source. One or both the power source and power bank direct energy to one or more electric motors coupled to pumps. A power management system directs the source and/or bank energy to the motors or to the power bank as appropriate for charging purposes. The power source can be a prime mover, such as a fuel-powered device, coupled to a generator, the prime mover being sized for supply up to the average power demand of the pumping operation, and the power bank is sized to supply up to at least the difference between the peak and average power demand of the pumping operation, thereby providing a load levelling means to satisfy peak demand of the operation. As a result, the prime mover can be operated at peak efficiency for average operation without a need for over-design to meet peak power demand.

The power management system manages the direction of current flow, a state of charge of the power bank, and power source operation to provide least fuel consumption while meeting the power demand of the pumping operation.

In one aspect, a powertrain is provided for a wellbore pumping operation having a power demand and a peak power demand. The powertrain comprises a power source producing a first power capacity at less than the peak power demand. A power bank is provided having a second power capacity. At least one electric motor is coupled to at least one pump, and power management system electrically connected to the power source, the power bank, and each motor, and configured to selectably direct electrical current from one or both of the power source and the power bank to one or both of the power bank and each motor. The power management system directs the electrical current for either or both energy sources to meet the power demand of the wellbore pumping operation.

In embodiments, the power management system is configured to selectably operate the powertrain in one of a hybrid mode or one or more non-hybrid modes, the power management system selecting the hybrid mode when the power demand of the wellbore pumping operation exceeds the first power capacity; and in the hybrid mode, a first electrical current is directed from the power source to each motor, and a second electrical current is directed from the power bank to each motor.

In embodiments, a variety of non-hybrid operational modes are also available including electric-only mode, a turbine-only mode, a charge-pump mode, and a charge-only mode. In the electric-only mode, the second electrical current is directed from the power bank to each motor. In the turbine-only mode, the first electrical current is directed from the power source to each motor. In the charge-pump mode, the first electrical current is directed from the power source to each motor, and a third electrical current is directed from the power source to the power bank. Further, in the charge-only mode, the third electrical current is directed from the power source to the power bank.

In another aspect, a powertrain for a wellbore pumping operation, is provided comprising a power bank, at least one electric motor coupled to at least one pump; and a power management system electrically coupled to the power bank and the at least one motor, and configured to direct electrical current from the power bank to each motor. In an embodiment, a power source is electrically connected to the power management system, wherein the power management system is further configured to selectably direct electrical current from the power source to the power bank.

In a method aspect, powertrain for a wellbore pumping operation is operated comprising: determining a power demand of the wellbore pumping operation; directing electrical current from a power source that produces power to each motor to meet a portion of the power demand, and directing electrical current from a power bank to each motor to meet a balance of the power demand. The power source has a first power capacity and the power bank has a second power capacity.

In an embodiment the method further comprises determining a state of charge of the power bank of the powertrain and directing electrical current from the power source to each motor and, based on the state of charge of the power bank, directing electrical current to the power bank and to each motor.

In embodiments the directing of the electrical current further comprises selecting, based on the power demand and the state of charge, an operating mode of the powertrain out of a hybrid mode and one or more non-hybrid modes. In the hybrid mode, the method comprises directing a first electrical current from the power source to each motor, and directing a second electrical current from a power bank to each motor. In the one or more non-hybrid modes the method comprises, in an electric-only mode, directing the second electrical current from the power bank to each motor. In a turbine-only mode, the method comprises directing the first electrical current from the power source to each motor. In a charge-pump mode, the method comprises directing the first electrical current from the power source to each motor, and directing a third electrical current from the power source to the power bank to charge the power bank. In the charge-only mode, the method comprises directing the third electrical current from the power source to the power bank.

DESCRIPTION

Figure 1A:
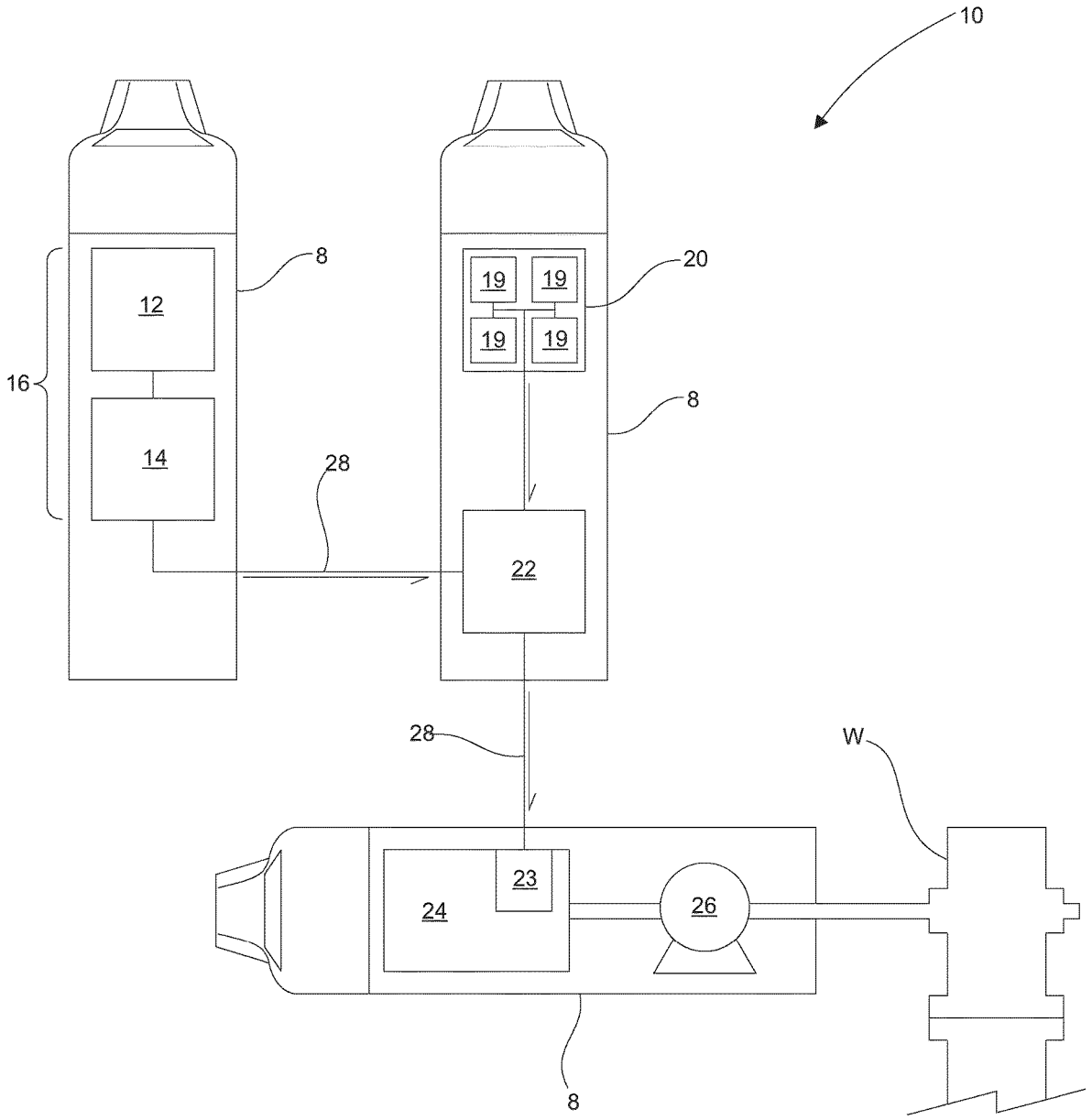
FIG. 1A is a schematic representation of an embodiment of a powertrain in a hybrid mode, using both generated energy and stored energy.

As used herein, the term "prime mover" means a machine for transforming energy into mechanical work, such as for example a diesel engine, gas turbine, electric motor, and the like. "Horsepower" means the shaft work that is produced by a prime mover, either at the flywheel or shaft of the diesel engine, electric motor, or gas turbine. "Hydraulic horsepower" (HHP) is a calculated number for determining how much power is required to pump a fluid, and is not the same as the horsepower produced by the prime mover. The industry accepted formula for calculating hydraulic horsepower is HHP=pressure (in PSI)*flow rate (in US gallons per minute)/1714.

Embodiments of an improved powertrain for use in wellsite operations are described herein. Wellsite operations are generally pressure pumping operations, such as wellbore stimulation (e.g. hydraulic fracturing), cementing, or acidizing. In exemplary embodiments herein, Applicant's invention is described with reference to a hydraulic fracturing operation. However, one of skill in the art would understand that the powertrain and methods described herein are applicable to any wellsite operation in which fluid is pumped downhole.

With reference to FIGS. 1A-1F, an embodiment of a wellsite operation powertrain 10 comprises one or more prime movers 12 operatively coupled to one or more generators 14 to function as a power generation assembly or power source 16, generating energy for producing power, and an energy storage or power bank 20 comprising one or more modules 19 containing power storage media 18 for storing and supplying power. Prime mover 12 can receive suitable fuel from a fuel source, such as a fuel tank or gas line (not shown). Power storage media 18 can comprise batteries or any other form of energy storage, such as capacitors. Herein, the power storage media 18 shall be assumed to be batteries.

The power generation assembly 16 and power bank 20 can be electrically connected to a power management system 22. The power management system 22 is electrically connected to one or more electric motors 24 configured to drive one or more fracturing pumps 26 to pump fluid into the wellbore W. In hydraulic fracturing operations, pump 26 is typically a plunger-style positive displacement pump. The various components of the powertrain 10 are electrically connected by known means including via electrical cables 28. The arrows in FIGS. 1A-1F indicate the direction of current flow in a given operational mode.

FIGS. 1A-2C show components of the powertrain 10 mounted on the beds of trucks 8 for convenient transport. However, one of skill in the art would understand that the components of the powertrain 10 can be provided in various different arrangements on trucks 8, or alone without any trucks 8 such as on skids or other forms of transport. Further, while only one prime mover 12, generator 14, motor 24, and pump 26 are shown for the sake of simplicity, combinations of one or more of prime movers 12, generators 14, motors 24, and pumps 26 may be used to provide the necessary pumping power for the wellsite operation.

The power management system 22 is configured for allocate current according to various operational modes of the powertrain 10. The power generation assembly 16 can be sized to generate enough energy to power the motors 24 so as to provide up to at least the average HHP demand of the wellbore operation. The power bank 20 can be sized to supply enough energy to at least make up enough power to the motor 24 to provide up to at least the peak HHP demand of the wellbore operation, when combined with the power generated by the power generation assembly 16. In this manner, the prime mover 12 can be run at a fuel efficient load for most of the duration of the wellbore operation as opposed to idling, and does not need to be oversized to meet peak HHP demand. Aa a result, the system provides a significant improvement in fuel consumption as compared to conventional fueled systems sized for peak demands.

Each electric motor 24 can be directly coupled to its respective pump 26, thereby dispensing with the need for a hydraulic transmission or gearbox and the corresponding limits to pumping rate. By eliminating the hydraulic transmission, the pumping rates of the present powertrain 10 can be greatly increased. The various components of the powertrain 10 shall now be described in further detail.

In an embodiment, prime mover 12 is a gas turbine. The gas turbine 12 is configured to be primarily fueled by natural gas, but can also be configured to be fueled by any suitable hydrocarbon fuel such as propane, diesel fuel, kerosene, jet fuel or a combination thereof. The turbine 12 can also be configured to be capable of switching between various fuels "on the fly" such that, if there is an interruption to the natural gas supply, the gas turbine 12 can be switched to a standby supply of diesel fuel or other fuels without shutting down the turbine 12.

Use of a gas turbine 12 is advantageous over conventional diesel engines, as such turbines 12 provide a reduction of emissions of approximately 30%. In particular, CO2, NOx, and particulate emissions are reduced through use of a gas turbine. A further advantage of using a gas turbine 12 over conventional diesel engines is a significant reduction in noise emissions. For example, observed sound pressure levels of diesel engines are approximately 100-103 dB at 1 meter. In contrast, a packaged gas turbine MPU unit available from Siemens of 4615 Southwest Freeway, Suite 900, Houston, TX 77027, United States, rated at 85 dB at 1 meter, and the addition of an optional quiet kit can reduce the noise to 58 dB. Diesel engines also typically produce a lower frequency noise, which carries farther than the higher pitched noise produced by a gas turbine. Thus, a turbine is less likely to disturb people and wildlife living close to the worksite.

While the prime mover 12 is referred to as a gas turbine in embodiments herein, any other suitable source of mechanical power for generating energy may be used as a prime mover, such as a diesel engine, natural gas fired reciprocating engine, steam turbine, and the like.

Prime movers 12 and coupled generators 14 are typically manufactured in a variety of different capacities. Thus, multiple prime movers 12 and generators 14 of different sizes may be used to supply the desired amount of power for the wellsite operation. When the anticipated power demands are greater the output of a single prime mover 12, multiple prime mover 12 and generator 14 units can be brought to the wellsite and operated together as a power generation assembly 16, or microgrid. For example, prime movers 12 are available in sizes supplying 3.4 MW and 5.7 MW of power. Prime movers units 12 can be sized up to 30 MW and, when applied to meet peak demand, such units are large, heavy, present a single point of failure, require many trucks to transport, and take 7 to 11 days to commission and bring into operation.

In comparison, smaller prime movers 12 as employed herein can be commissioned and operational in as little as 2 hours after being driven to the wellsite, and are easier to transport. Thus, it is preferable to use multiple smaller prime movers 12 and generators 14 to provide average power for the operation. A further advantage of utilizing power generation assemblies 16 comprised of smaller prime mover 12 and generator 14 units is that, should a single prime mover 12 or generator 14 fail, there remain other prime movers 12 and generators 14 that, when combined with the added energy of the power bank 20, can provide enough power to flush (displace) the wellbore of proppant and leave the wellbore filled with clean water. This will prevent the wellbore being "sanded off" in the event of the failure of a prime mover 12 or generator 14 and ensure that fracturing operations can recommence once the cause of the failure has been rectified.

Figure 3:
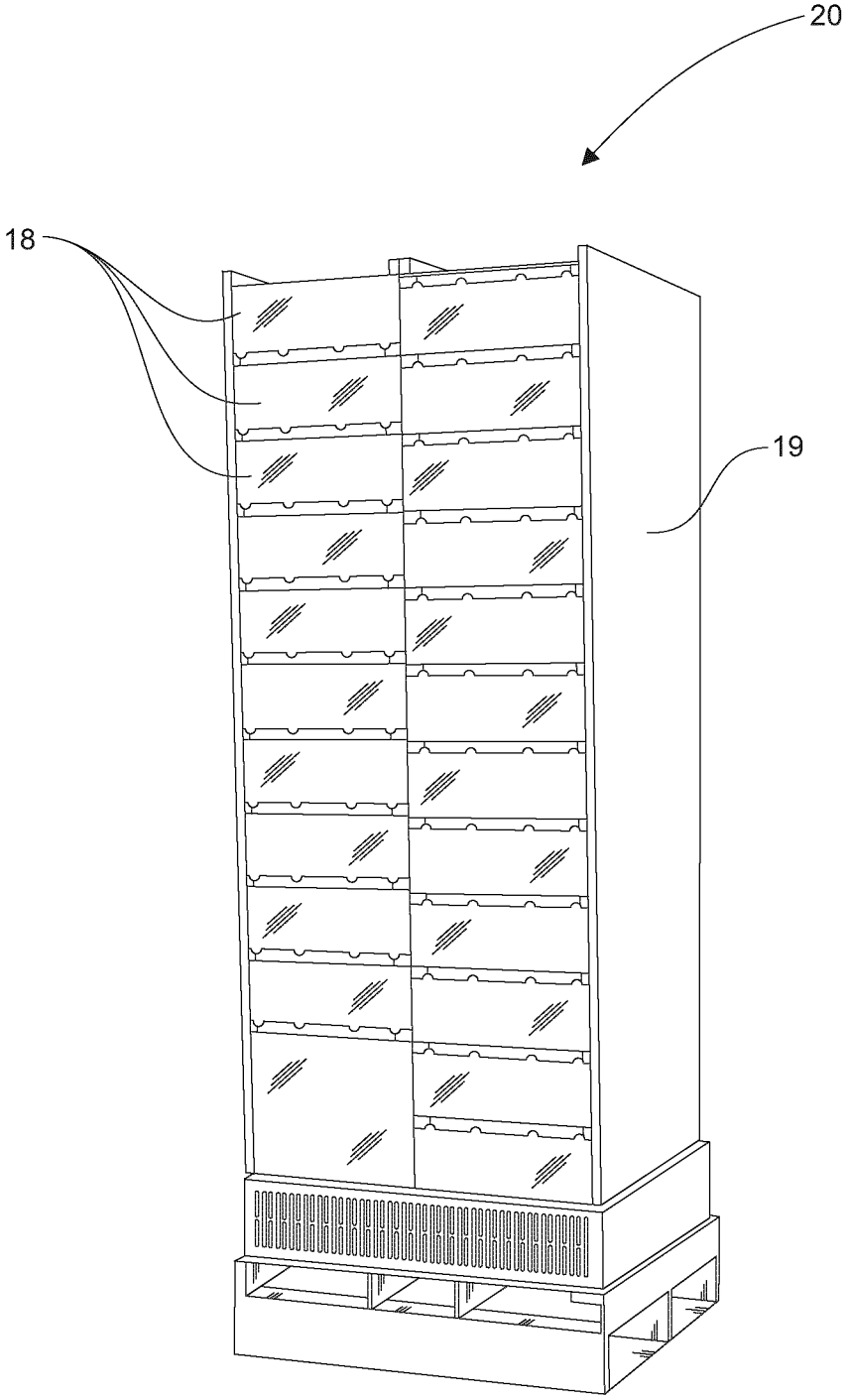
FIG. 3 is a perspective view of an embodiment of a battery module of the powertrain containing multiple battery packs.

With reference to FIG. 3, the power bank 20 comprises a plurality of battery packs 18, each pack containing a plurality of battery cells. The battery packs 18 can be configured to provide voltages higher than that of a single battery cell, such as by arranging the batteries in series, according to the power demand of the wellsite operation. The battery packs 18 can be further consolidated into larger battery modules 19 for convenient transportation and replacement. The battery modules 19 can be electrically tied together via a bus, such that the battery packs 18 do not need to be individually wired to the power management system 22.

In preferred embodiments, the battery packs 18 are thermally managed, such that they do not overheat and avoid catching fire, or become too cold where their performance for both charging and discharging is reduced. As such, the battery modules 19 can be arranged onto an electrical trailer or container that is climate controlled to ensure the battery packs 18 are maintained substantially at ideal temperatures, or within an ideal temperature range, for charging and discharging. Such ideal temperatures change according to the specific chemistry of various batteries, but are typically in the range of 15-35° C. The number of modules 19 can be changed according to the individual power requirements and level of redundancy required for a particular fracturing operation. In embodiments, power bank 20, the battery thermal management system, and/or the power management system 22 may be integrated into a single unit for ease of transportation.

In one embodiment, the battery packs 18 comprise multiple lithium ion cells, chosen for their desirable combination of energy density, lifetime number of charge and discharge cycles, and cost. However, as one of skill in the art would understand, any suitable battery type that is capable of accepting and delivering charge from an external load or power source can be used.

The electric motor 24 is typically an AC induction motor rated between 2,000-3,000 HP, but other suitable types and power ratings (such as DC motors) can be used depending upon job conditions, desired fluid flow rate to be pumped, and weight restrictions for equipment transport. Where AC motors 24 are used, respective variable frequency drives (VFD) 23 are located between the power management system 22 and the AC motors 24. The VFD 23 provides a method of controlling the speed of an AC motor steplessly from zero to the maximum rotational speed of the motor. The VFD 23 allows an AC motor to mimic the control available to vary the speed of a DC motor by varying DC voltage. One or more VFDs 23 may control multiple electric motors 24. If a DC motor is used, a VFD 16 is not necessary, but alternative well known speed regulating means are used in place of a VFD, such as adjusting voltage to the DC motor 24 with rheostats or potentiometers, or varying the speed of the prime mover 12.

Typically, multiple motors 24 and accompanying VFDs 23 drive multiple pumps 26 to meet the HHP demand of the operation, as a single motor-driven hydraulic pump 26 would be too large to practically transport to the well site. For example, for large well operations, it is impractical or impossible to use a single pump to provide the total fluid rate, as present pumps are only available up to 5000 hp, and are too wide to move on highways without obtaining special permits.

The power management system 22 can comprise components for regulating and converting the electrical power from the generator 14 to a form appropriate for driving the electric motor 24 and charging the power bank 20. Generator 14 typically produces AC current which must be rectified to DC current having a specific voltage and current in order to charge the battery packs 18 of the power bank 20 without damaging them. As such, the power conditioning module 22 can comprise rectifiers, transformers, and other equipment for conditioning current from the generator 14 to be suitable for charging the battery packs 18. Similarly, when power is drawn from the power bank 20, it may need to be stepped up or down and inverted to AC current to drive the electric motor 24. Accordingly, the power management system 22 can comprise suitable transformers and inverters for conditioning the current from the power bank 20 to be suitable for driving the motor 24.

The power management system 22 can further be configured to manage power for the entire pumping operation. For example, the management system 22 can have computer processors, machine-readable media, input/output interfaces, or other suitable components operative to manage the output of the power generation assembly 16 and the power bank 20, monitor the state of charge of the power bank 20, monitor the power demands of the motor 24, and automatically adjust the operation of the system in a manner to minimize fuel consumption while providing enough power to meet the pumping demands of the wellsite operation. In embodiments, the power management system 22 can also be configured to communicate with, and receive instructions from, a fracturing controller configured to control the entire wellsite operation, such that control of the powertrain 10 is centralized at the fracturing controller.

Figure 1B:
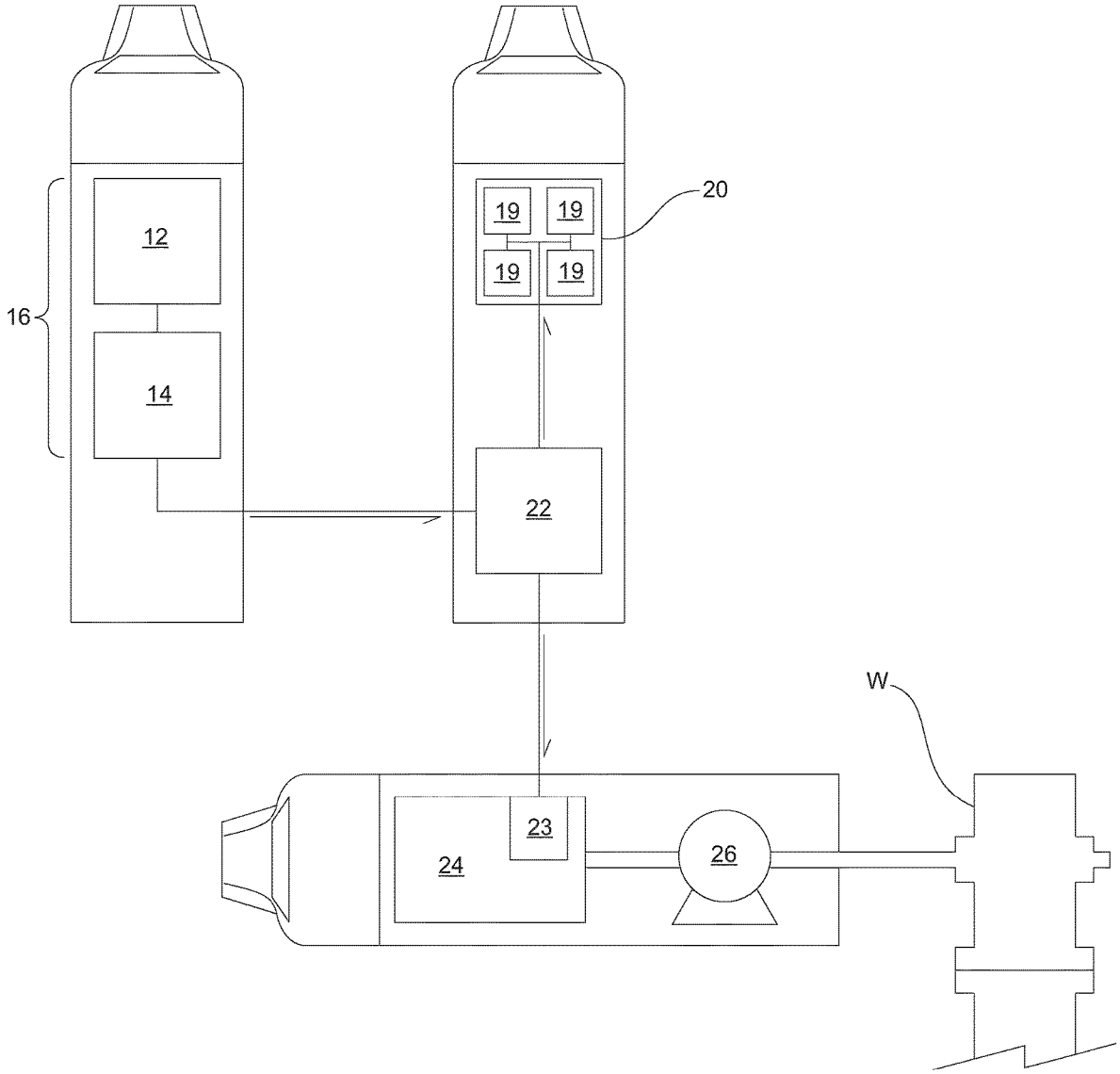
FIG. 1B is a schematic representation of an embodiment of a powertrain in a charge-pump mode using excess generated energy directed to storage.
Figure 1C:
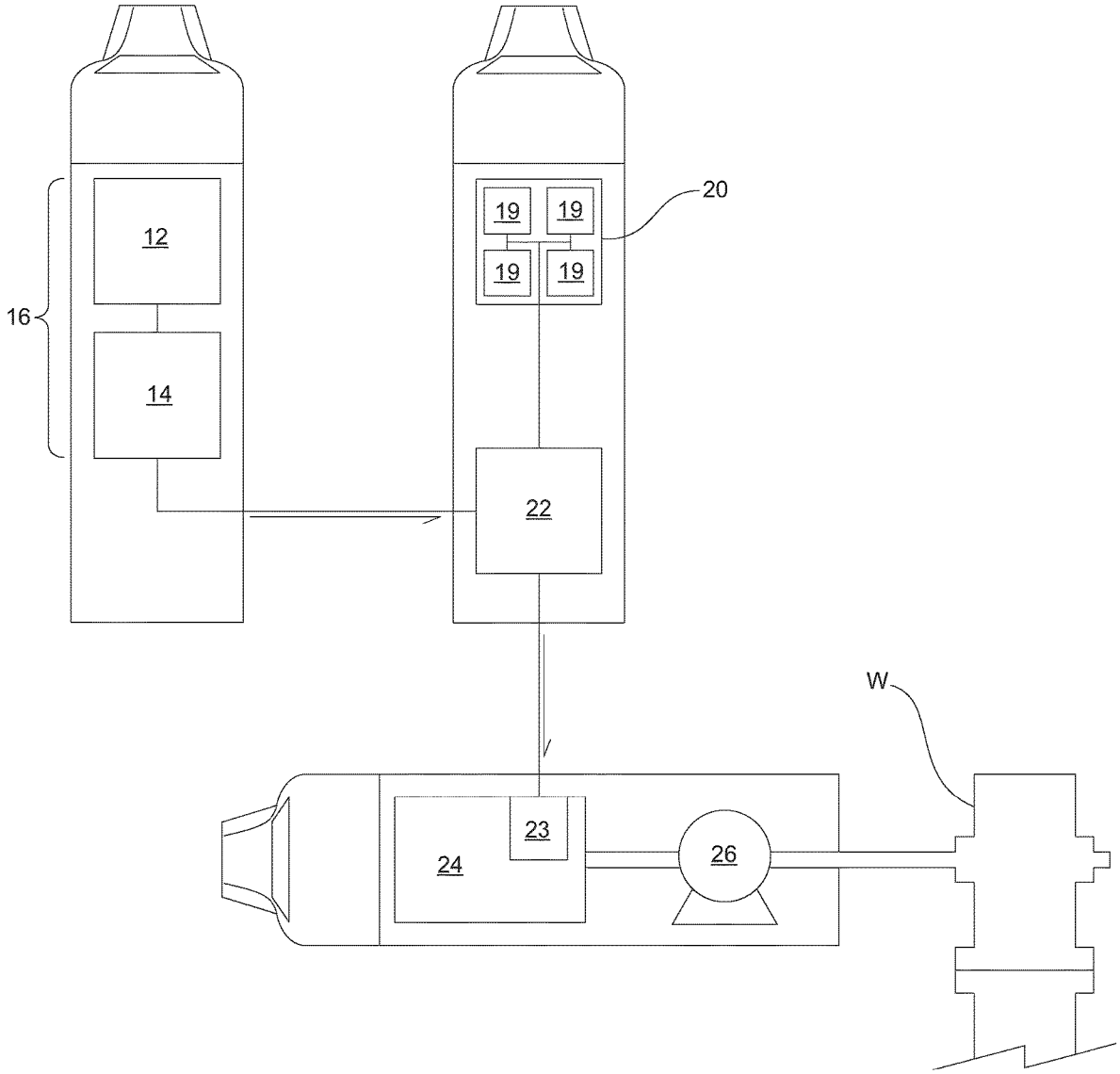
FIG. 1C is a schematic representation of an embodiment of a powertrain in a generated-energy mode only.
Figure 1D:
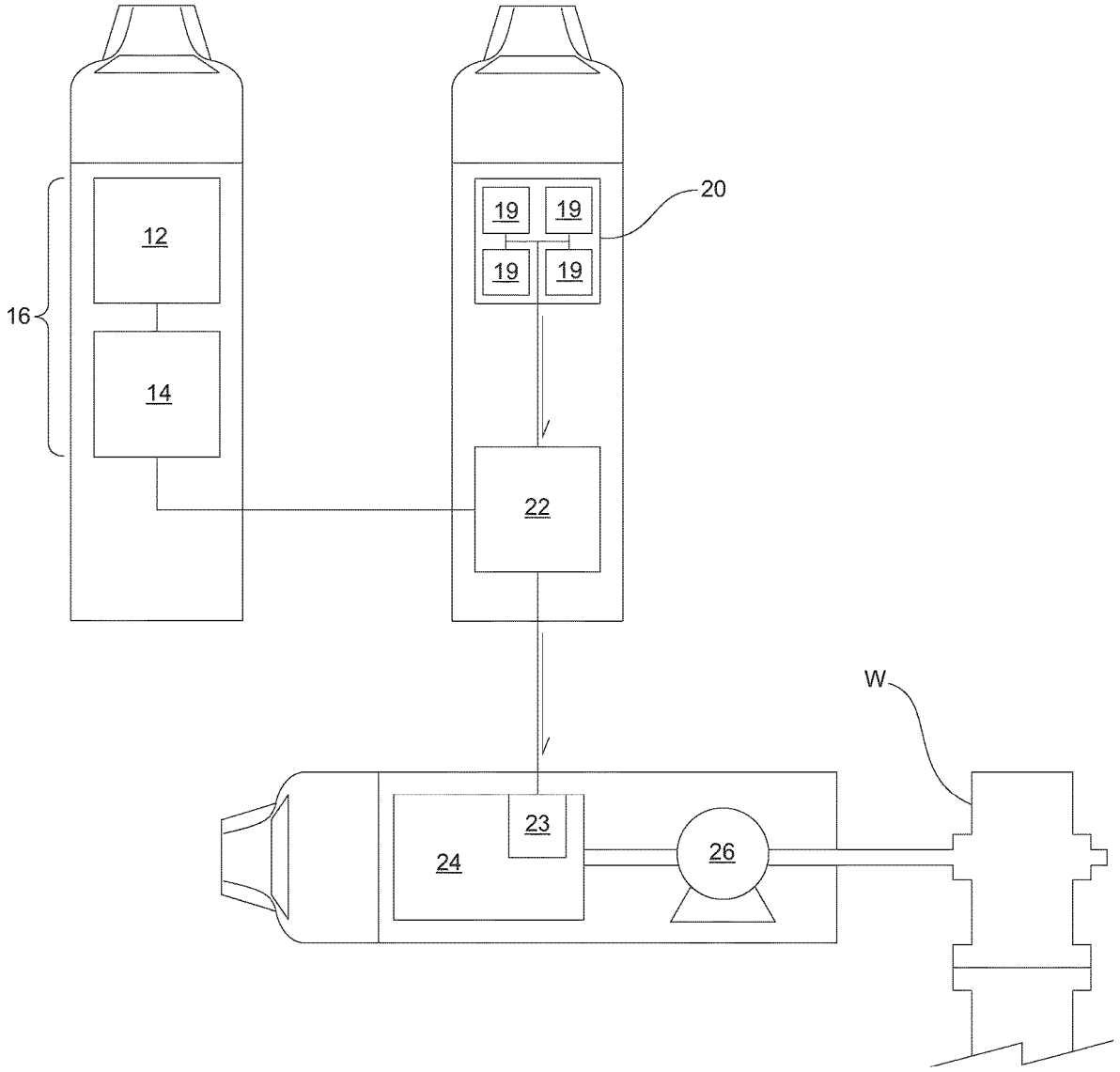
FIG. 1D is a schematic representation of an embodiment of a powertrain in a stored energy mode only.
Figure 1E:
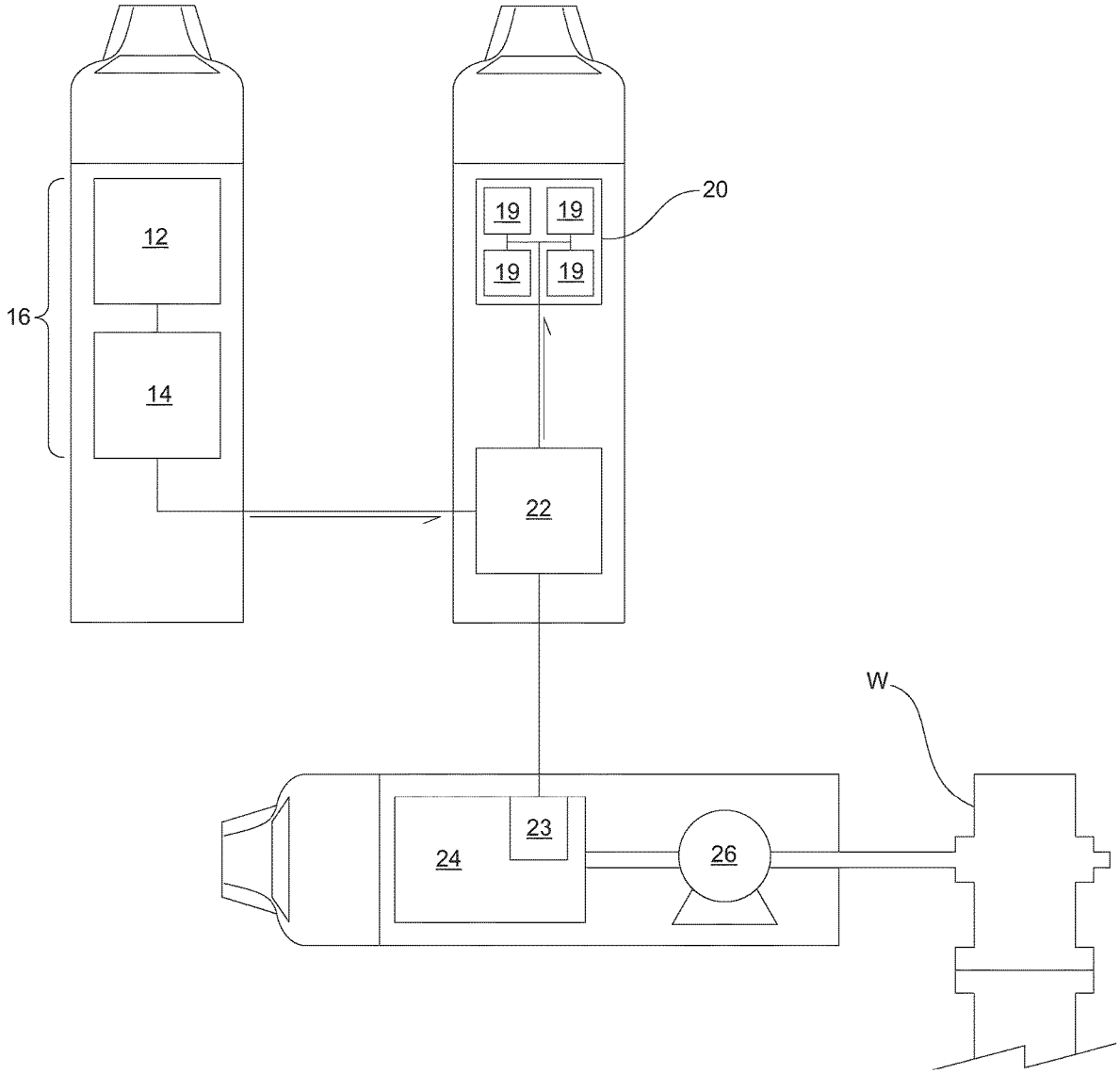
FIG. 1E is a schematic representation of an embodiment of a powertrain in a charge-only mode using generated energy directed to storage.
Figure 1F:
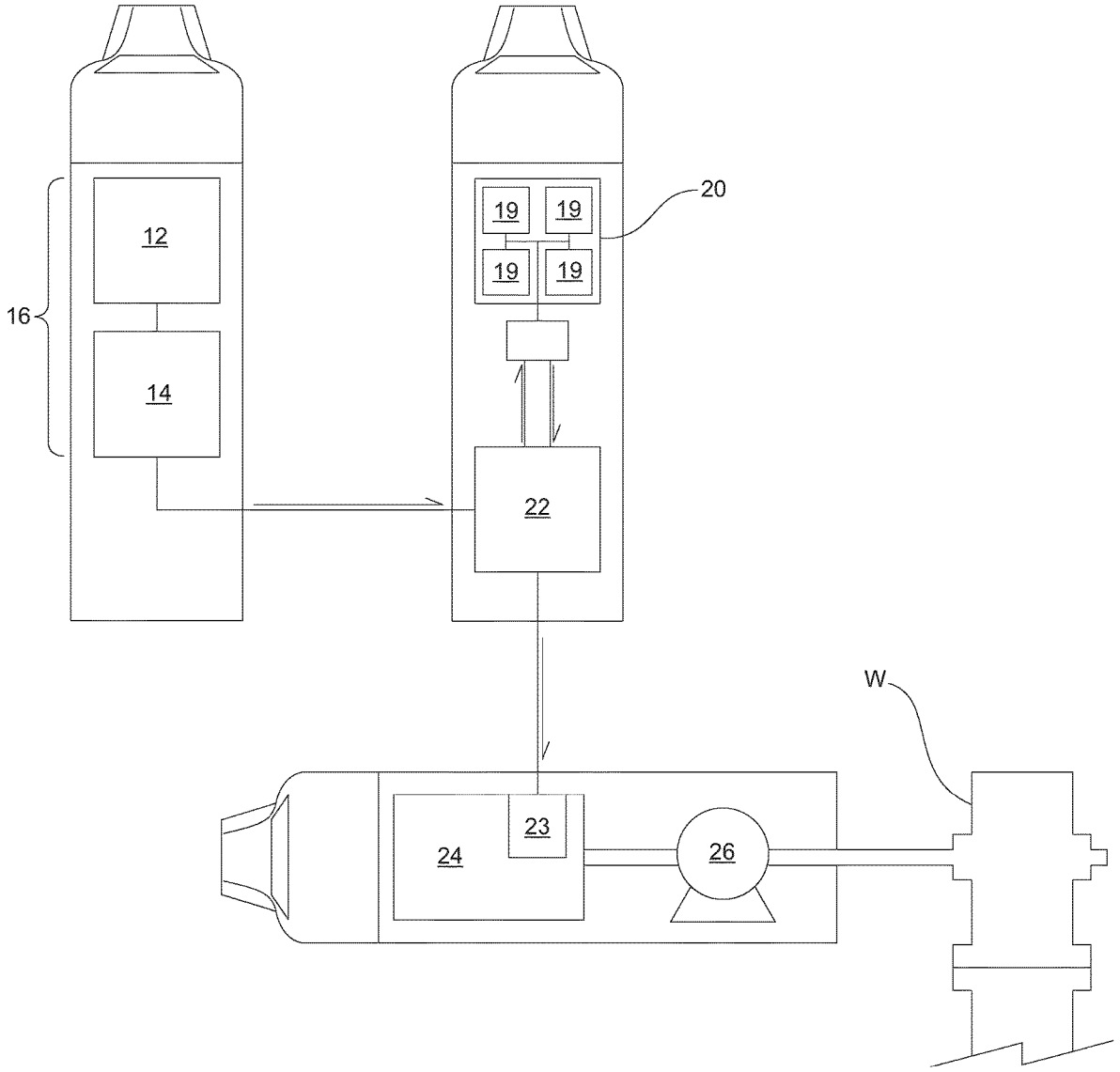
FIG. 1F is a schematic representation of an embodiment of a powertrain in a charge-electric mode in which the generated energy is sent to storage and all energy for the powertrain is drawn from storage.
Figure 2A:
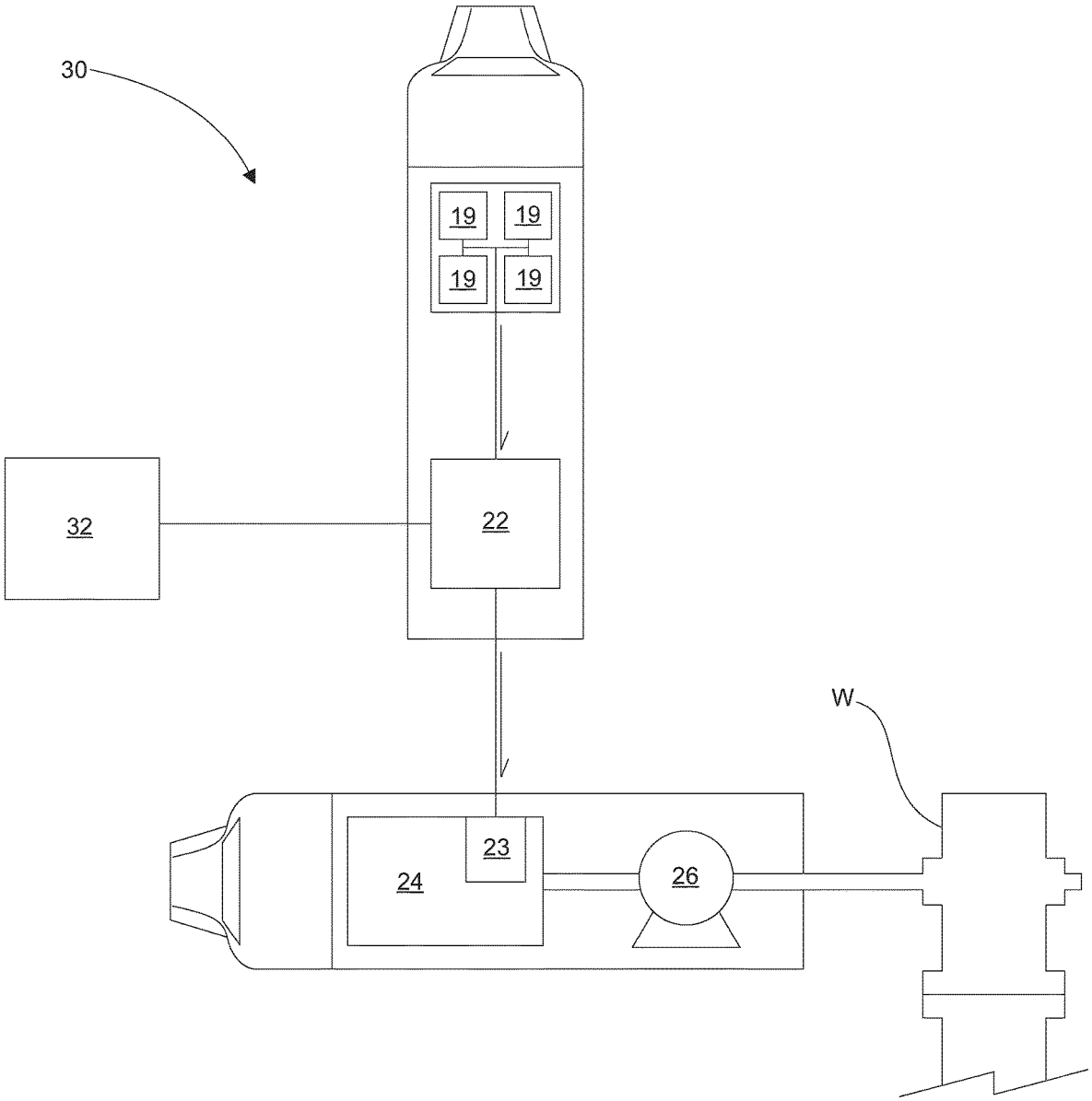
FIG. 2A is a schematic representation of an embodiment of an electric powertrain in an electric-only mode.
Figure 2B:
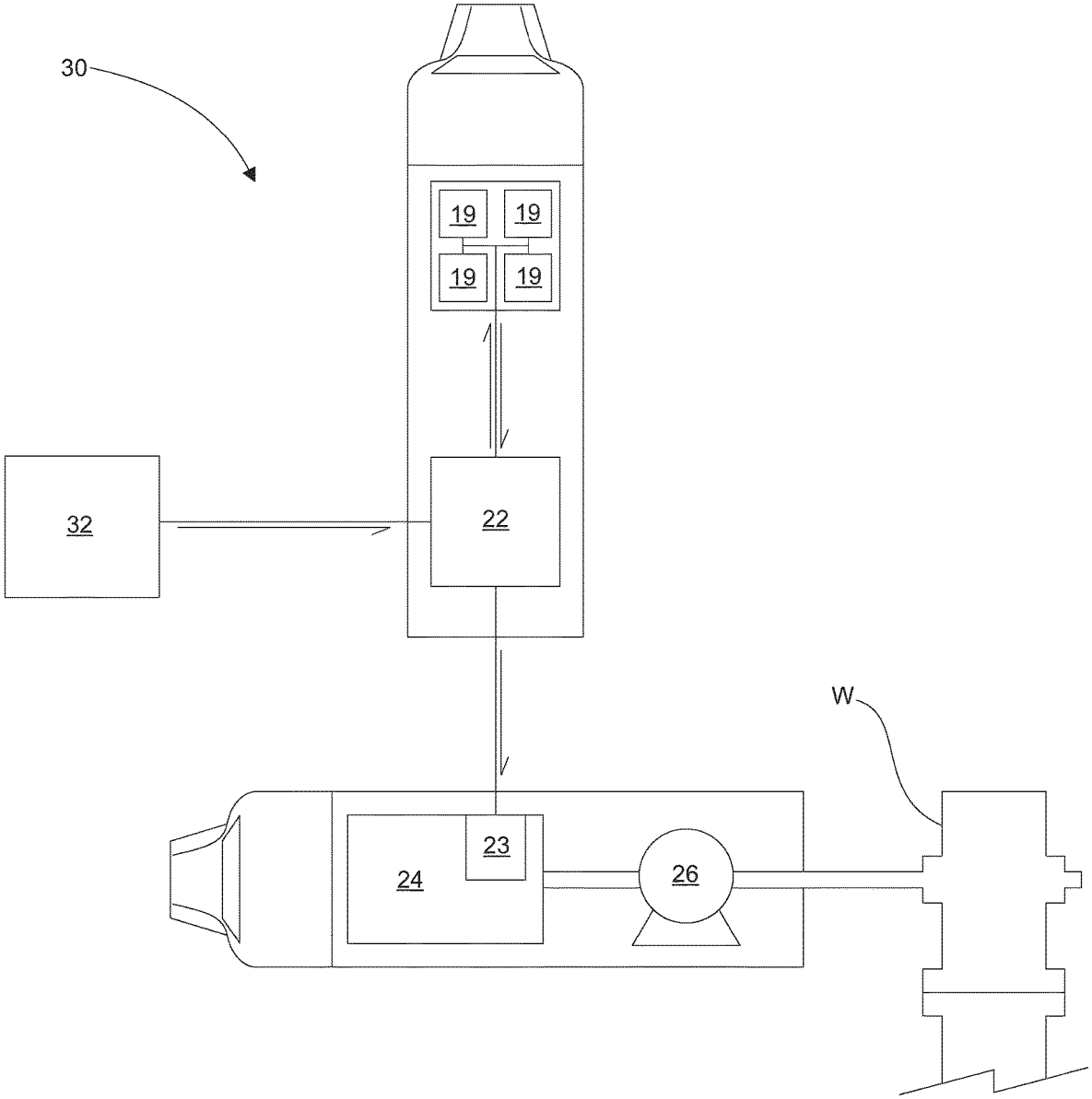
FIG. 2B is a schematic representation of an embodiment of an electric powertrain in a charge-electric mode.
Figure 2C:
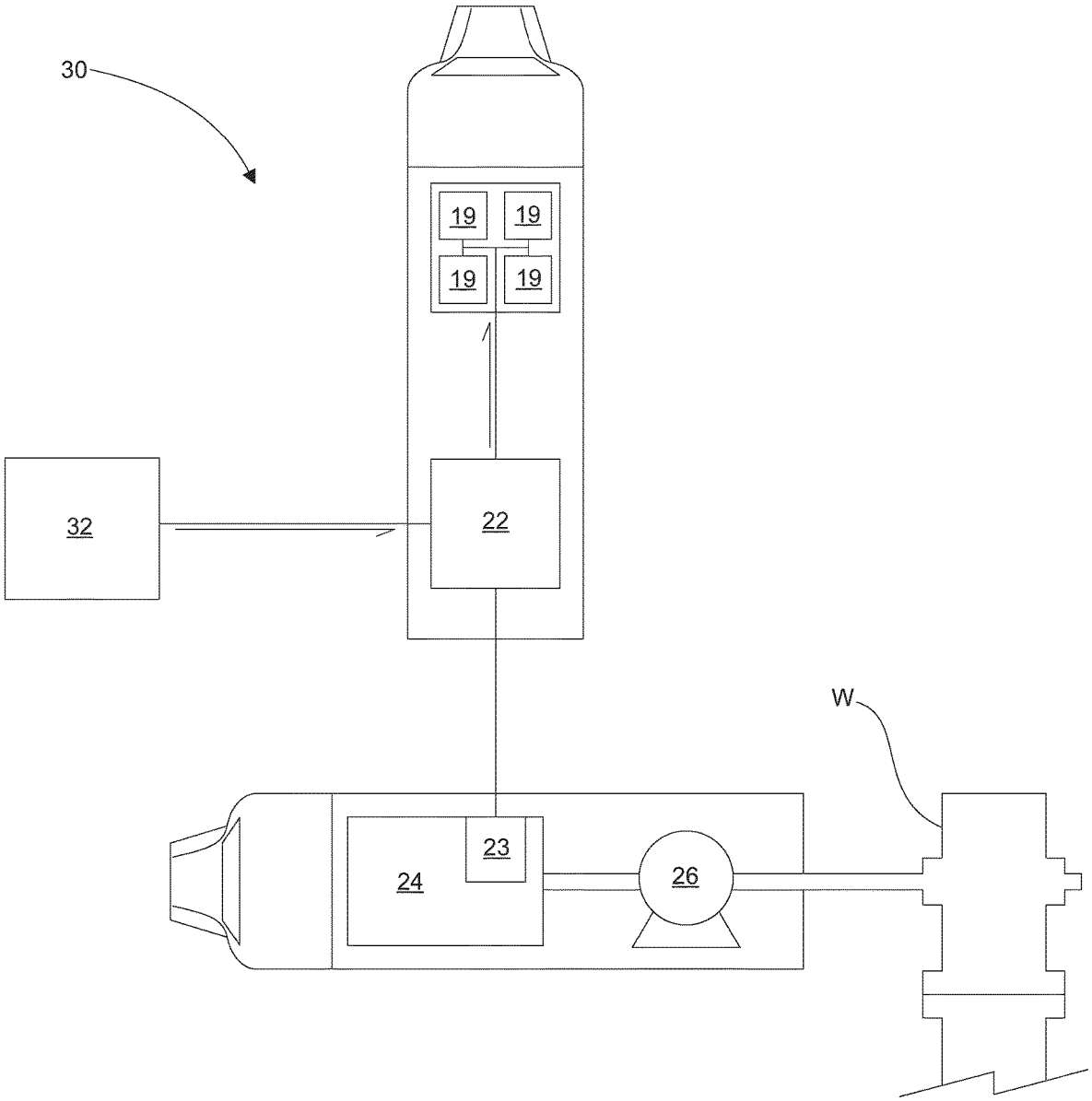
FIG. 2C is a schematic representation of an embodiment of an electric powertrain in a charge-only mode.

With reference to FIGS. 1A-1F, to optimize the operation of the powertrain 10, the power management system 22 can be configured to selectably run the powertrain 10 in a number of operational modes. In the depicted embodiment, the power management system 22 can operate the powertrain 10 in a hybrid mode (FIG. 1A), charge-pump mode (FIG. 1B), turbine-only mode (FIG. 1C), electric-only mode (FIG. 1D), charge-only mode (FIG. 1E), or charge-electric mode (FIG. 1F).

When the powertrain 10 is in the hybrid mode, the power management system directs current from the power generation assembly 16 and power bank 20 to the electric motor 24, such that the motor 24 is powered by both the power generation assembly 16 and the power bank 20. With reference to FIG. 1B, when the powertrain 10 is in the charge-pump mode, the power management system 22 directs some of the current generated by the power generation assembly 16 to meet a low energy demand of the electric motor 24, and the remaining surplus current to the power bank 20 to charge the battery packs 18 thereof. In the turbine-only mode of FIG. 1C, the power management system 22 directs all of the current generated by the power generation assembly 16 to the electric motor 24, and no current is either directed to or drawn from the power bank 20. In the electric-only mode of FIG. 1D, the power generation assembly 16 does not generate any current, and the power management system 22 draws current only from the power bank 20 and directs said current to the electric motor 24. This mode is useful if a fuel-powered generator is down or being serviced.

In the charge-only mode, the power management system 22 directs all of the current generated by the power generation assembly 16 to the power bank 20. This can charge the power bank when well operations have ceased. In the charge-electric mode, the power management system 22 directs all of the current generated by the power generation assembly 16 to the power bank 20, and draws current from the power bank 20 to power the motor 24. This is useful for alternate power management of the motor.

The power management system 22 can be configured to select the appropriate operational mode in response to various factors, such as the state of the charge of the power bank 20, the power demands of the motor 24, and to optimize the system for the greatest fuel efficiency. The power management system 22 can be further configured to automatically compensate for situations wherein the gas turbine 12 is derated due to factors such as elevation and temperature, such that any shortfall of power generated by the gas turbine 12 can be compensated by drawing power from the power bank 20 to meet the HHP demand of the wellsite operation.

In embodiments, the power management system 22 can be comprised of a number of discrete modules that perform specific functions as opposed to an integral unit. For example, a battery management module that adjusts the charging rate and state of charge of the batteries, such as a module commercially available from Lithium Werks in the Netherlands, can be installed in the power management system 22 and be configured to communicate with other components of the system 22 through a CAN bus protocol. Another module that can be part of the power management system 22 is a turbine/generator controller, such as the controller forming part of the Siemens MPU (Mobile Power Unit) which is a combined gas turbine and generator package that is trailer mounted and can be transported as a single load.

Example Pumping Operation

Figure 4A:
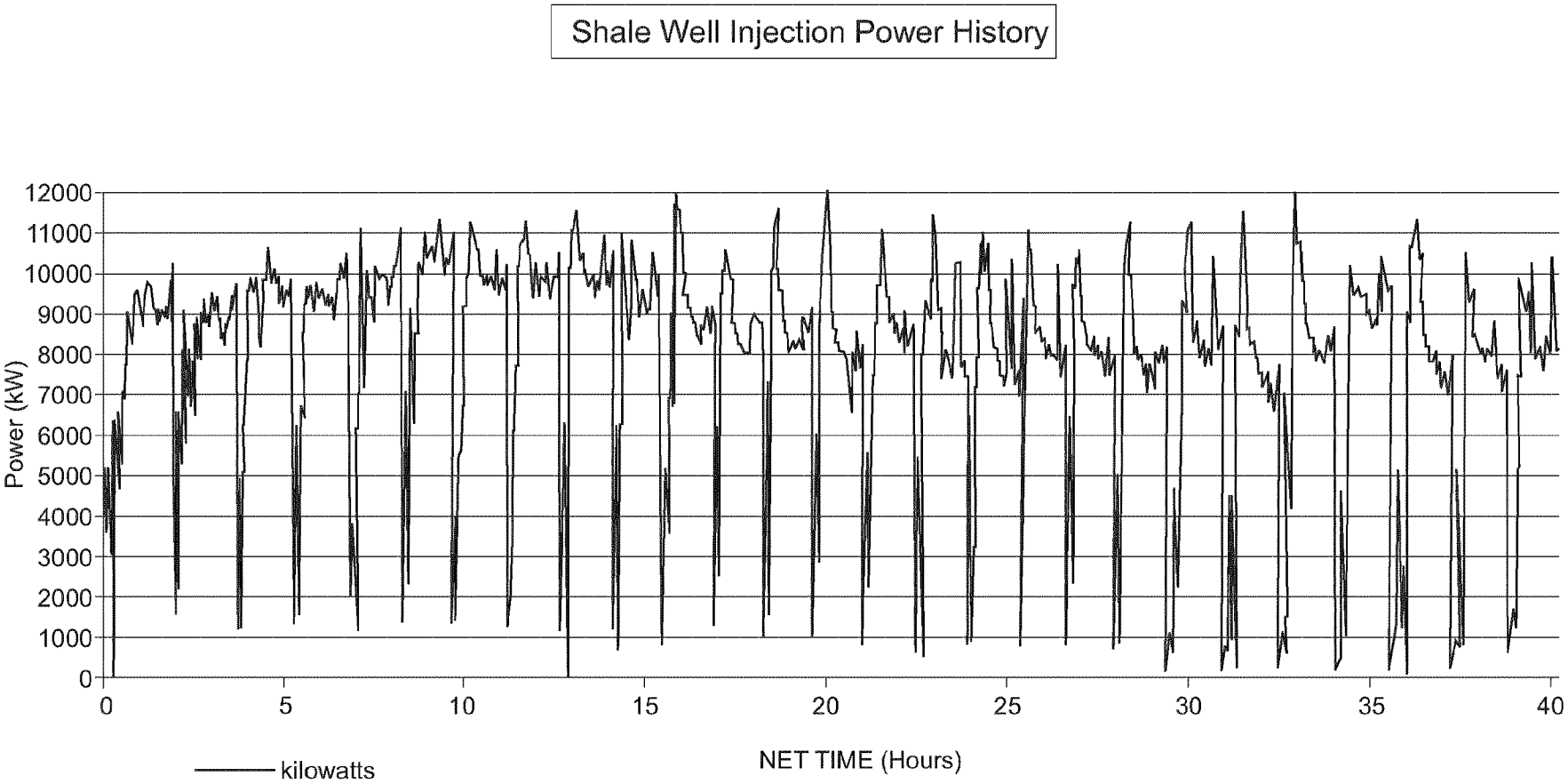
FIG. 4A is an illustration of the typical power demands over time of a multistage fracturing operation.
Figure 4B:
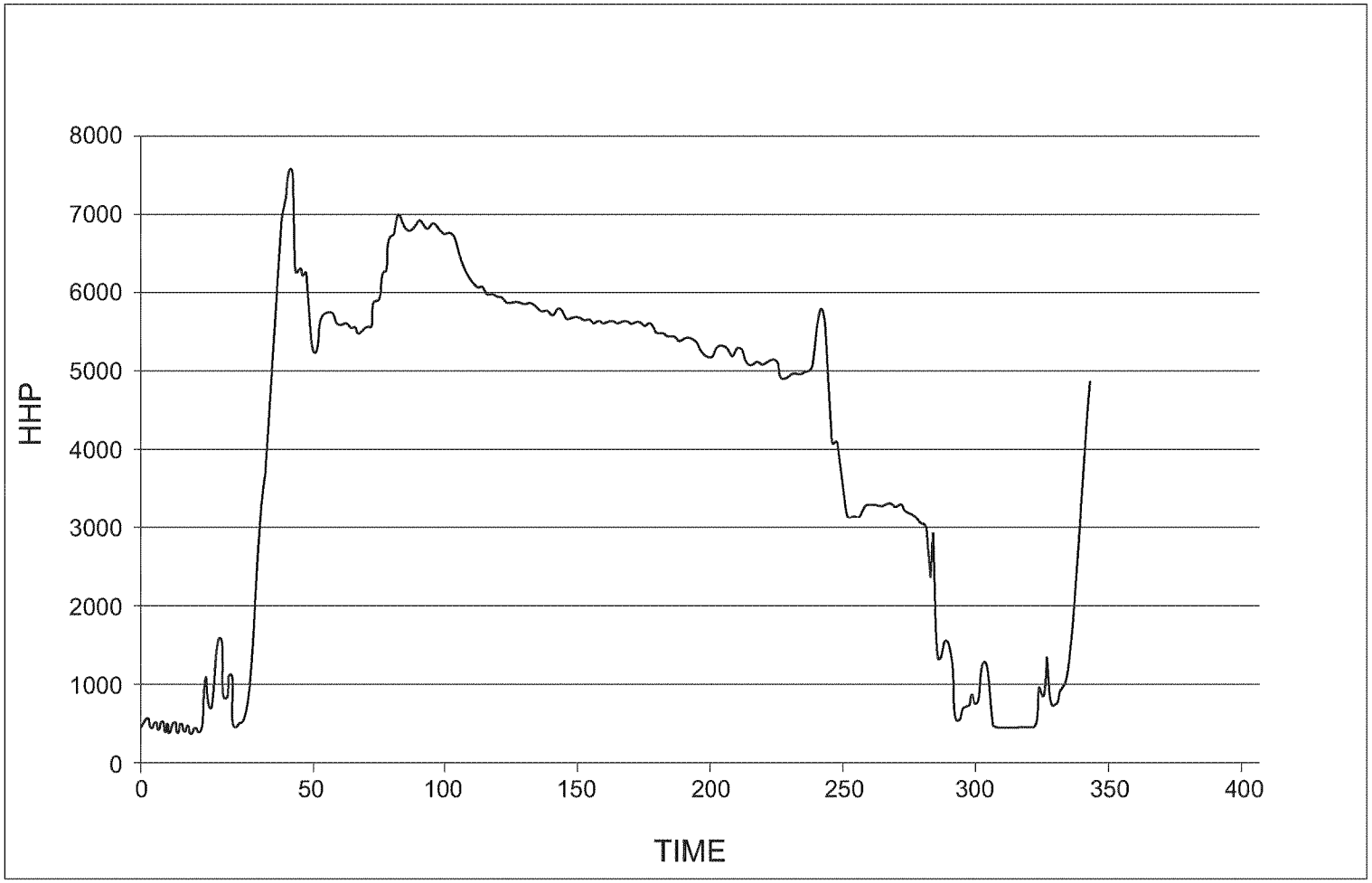
FIG. 4B is an illustration of the power demand over time of a single stage of a low sand concentration fracturing operation.
Figure 4C:
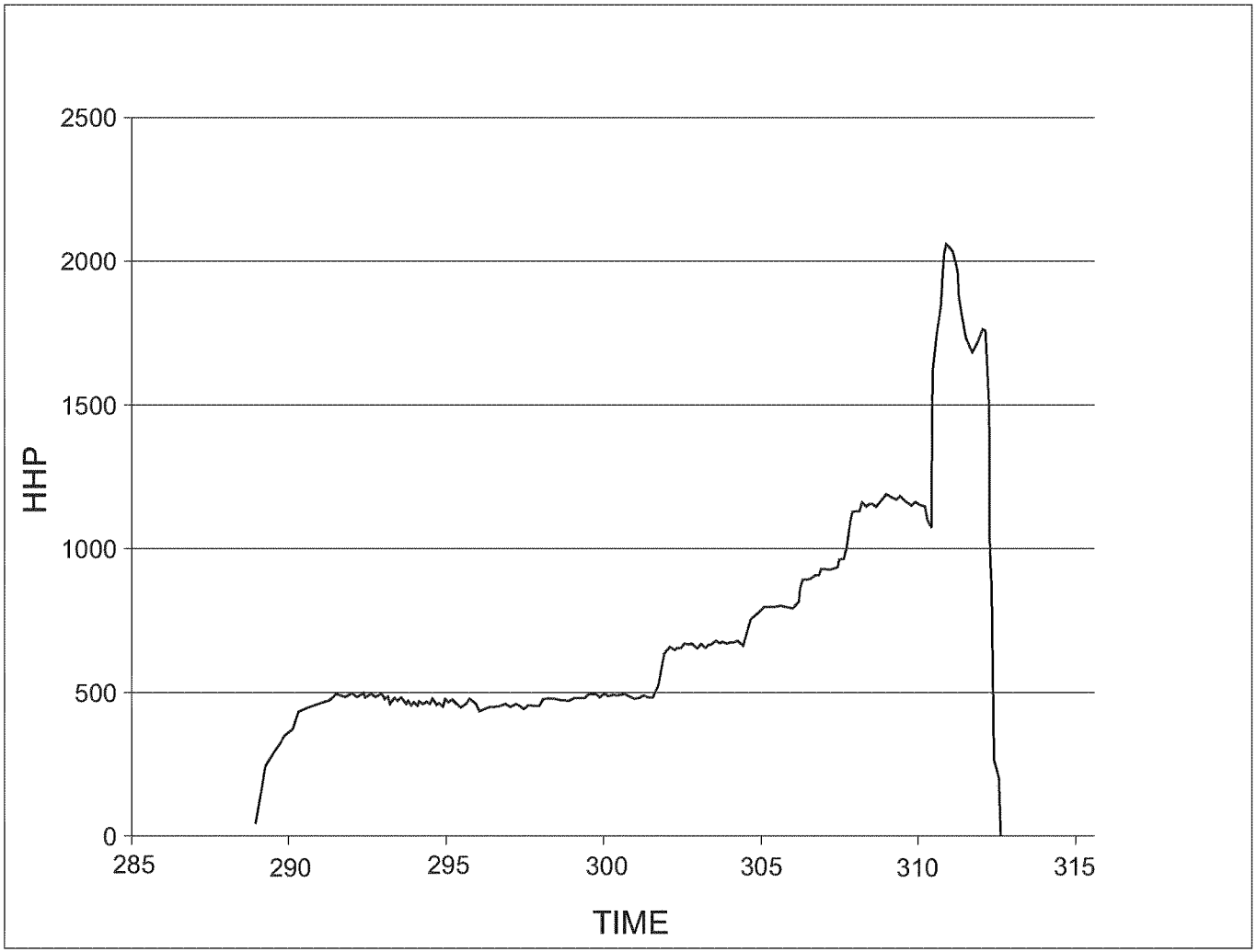
FIG. 4C is an illustration of the power demand over time of a single stage of a high sand concentration fracturing operation.

FIG. 4A is an excerpt from SPE paper number 187192 (the "SPE Paper") and provides an example of the time-power plot recorded from a 27 stage fracturing operation in a well in Oklahoma. From the plot, it can be seen that the peak HHP demand of the operation is approximately 12,000 kW, but such peak HHP is only required for very short periods of time to initiate fracturing. From the data in the SPE Paper, it can be calculated that the average HHP demand is 8125 kW, and the difference between the peak and average HHP demand is approximately 3875 kW.

To supply power for the fracturing operation example set forth in the SPE Paper, the prime movers 12 and generators 14 of the present powertrain 10 are sized to provide up to at least the average equivalent HHP demand of the fracturing operation, and the power bank 20 is configured to provide up to at least the difference between the peak HHP and average HHP demand to the motor 24, such that the prime mover 12 and power bank 20 together are capable of providing up to at least the expected peak HHP demand of the operation. In preferred embodiments, the prime movers 12, generators, 14, and power bank 20 are configured to cumulatively provide up to 20% greater power than the expected peak HHP demand, such that redundant power is available in the operation in the event of an unexpectedly high HHP demand, the failure of one or more prime movers 12, generators 14, or battery packs 18, etc. In this manner, the prime movers 12 and generators 14 can supply power to the electric motors 24 for most of the fracturing operation, and the remaining power demand above the average HHP demand is provided by the power bank 20 for the short amount of time needed.

In another embodiment, for the SPE Paper fracturing operation shown in FIG. 4A, the prime movers 12 are sized to provide 8125 kW of equivalent HHP. The power bank 20 is configured to provide the remaining 3875 kW of power such that the electric motors 24 can provide 12,000 kW of HHP to meet peak HHP demand.

In use, with reference to FIG. 1A, if the motor 24 requires power above 8125 kW, for example during initiation of a fracture, the power management system 22 can operate the powertrain 10 in the hybrid mode such that both the power generation system 16 and power bank 20 supply power to the motors 24 to meet the HHP demand of the operation. With reference to FIG. 1B, if the HHP demand of the fracturing operation falls below 8125 kW, then the power management system 22 operates the powertrain 10 in the charge-pump mode and directs any power generated by the power generation system 16 and not required to satisfy the HHP demand to the power bank 20 to replenish its stored energy. With reference to FIG. 1C, if the demand of the fracturing operation is below 8125 kW and the power bank 20 is already at or above an upper threshold efficiency level, such as 80% charge, the power management system 22 can operate the powertrain 10 in the turbine-only mode and such that no power is directed to the power bank 20, and adjust the speed of the prime movers 12 to maintain the pumping rate of the operation within a desired range.

Alternatively, turning to FIG. 1D, if the power bank 20 has sufficient charge and is capable of supplying enough power to meet the HHP demand of the operation, the power management system 22 can operate the powertrain 10 in the electric-only mode such that the prime mover 12 can be shut off completely and the power bank 20 supplies all of the power to meet the HHP demand. With reference to FIG. 1E, if the fracturing operation does not require any power, for example when the operation has completed a fracturing stage and has not yet begun the next stage, the power management system 22 can operate the powertrain in a charge-only mode and direct all power generated by the power generation assembly 16 to the power bank 20 to replenish its stored energy. With reference to FIG. 1F, the power management system 22 can also operate the powertrain 10 in a charge-electric mode, wherein the power bank 20 supplies all of the power to meet the HHP demand, and all power from the power generation assembly 16 is directed to the power bank 20.

In embodiments, the power management system 22 can be configured to run the prime movers 12 at about their most fuel efficient load for as much of the wellbore operation as possible, only idling the prime movers 12 when necessary. As the prime movers 12 are sized to provide the average HHP demand of the operation, and the power generated by the power generation assembly 16 can be used to fulfill HHP demand and/or charge the power bank 20, the power management system 22 can select between the various modes of the powertrain 10 to keep the prime movers 12 operating at their most fuel efficient loads and effectively utilize all of the power generated thereby. As an example, gas turbines used as prime movers 12, operate at peak efficiency under full load. At idle, the specific fuel consumption of gas turbines at idle is very high, and thus it is desirable to operate the turbine 12 at full load for as long as possible and avoid idling. Therefore, the management system 22 can be configured to operate the turbines 12 at full throttle for as long as possible while the powertrain is operating in the hybrid, charge-pump, charge-electric, charge-only, or turbine-only modes. If needed, the management system 22 can reduce the speed of the turbines 12 in the turbine-only mode in order to maintain the pump rate of the operation within a desired range.

The power management system 22 can also control the power generation assembly 16 to respond to signals from a pumping control system of the operation. For example, if there is an event at the pressure pumping side of the wellbore operation, that necessitates an emergency shutdown of the fracturing pumps 26, the pumping control system can notify the power management system 22 of the anticipated shutdown, and the management system 22 can reduce the output of the power generation assembly 16 by reducing the throttle of the turbines 12 to eliminate the need for resistor banks to "receive" excess generated power.

Typically, output of the generators 14 is controlled by manipulating the field voltage thereof, and if the field voltage is removed, the generator output drops to approximately zero without the need to stop the rotation of the generator 14. As such, if the electrical load (i.e. the power demand of the operation) is reduced to zero in a short period of time, such as for a shutdown, the field voltage of the generators 14 can be reduced to zero to reduce their output to zero, and the speed of the turbines 12 can be reduced in a controlled manner. Thus, there is no need to engage a hard stop on the turbines 12 in the event the load is suddenly reduced to zero. There may be residual voltage generated due to inductance and impedance effects of the windings, but the relative output of the generators 14 will be approximately zero.

Electric Powertrain

In another embodiment, the powertrain can be a completely electric powertrain 30 wherein the power bank 20 is the only means to provide power to the motor 24. The power bank 20 is preferably brought to the wellsite in a charged condition such that they are ready to be used immediately. The power bank 20 can be charged by any suitable power source 32, such as a prime mover 12 and generator 14, hydro, wind, or solar power, or a nearby utility. Use of renewable power sources is preferred, such that the entire wellsite pressure pumping operation is carbon emission free. Alternatively, onsite sources of fuel, such as natural gas, can be supplied to the prime mover 12 to generate power to replenish the energy of the power bank 20.

Such a battery-only powertrain 10 can otherwise have a similar arrangement as the above-described hybrid powertrain 10, with a power source 32 replacing the power generation assembly 16. The power management system 22 can be configured to operate the battery-only powertrain 10 in an electric-only mode, a charge-electric mode, or a charge-only mode.

In alternative embodiments, no power source 32 is provided onsite, and discharged battery packs 18 of the power bank 20 are removed therefrom and transported offsite to be charged, such as at a base facility, before being transported back to the wellsite and reconnected to the power bank 20. Such embodiments can take advantage of lower overnight electricity rates at the base facility to charge the battery packs 18. In such embodiments, the powertrain 10 operates in the electric-only mode at all times.

The required size of the power bank 20 can be determined based on estimates of the HHP demands of the wellsite operation. Battery-only powertrains 10 are suitable for smaller operations where the cost of transporting, operating, and maintaining the battery packs 18 on site are lower than those of a hybrid powertrain 10. Otherwise, the above-described hybrid powertrain 10 can be used to supply power for the wellsite operation.

We claim:

1. A powertrain for a wellbore pumping operation having a power demand and a peak power demand, comprising:

a power source having a first power capacity less than the peak power demand;

a battery module comprising at least one battery, the at least one battery having a second power capacity;

at least one electric motor coupled to at least one pump; and a power management system electrically connected to the power source, the battery module, and each motor, and configured to selectably direct electrical current from the power source and the battery module to each motor, and from the power source to the at least one battery of the battery module, wherein the power management system directs the electrical current to meet the power demand of the wellbore pumping operation.

2. The powertrain of claim 1, wherein:

the power management system is configured to selectably operate the powertrain in one of a hybrid mode or one or more non-hybrid modes, the power management system selecting the hybrid mode when the power demand of the wellbore pumping operation exceeds the first power capacity; and in the hybrid mode, a first electrical current is directed from the power source to each motor, and a second electrical current is directed from the battery module to each motor.

3. The powertrain of claim 2, wherein;

the one or more non-hybrid modes comprise at least an electric-only mode, a turbine-only mode, a charge-pump mode, and a charge-only mode;

in the electric-only mode, the second electrical current is directed from the battery module to each motor;

in the turbine-only mode, the first electrical current is directed from the power source to each motor;

in the charge-pump mode, the first electrical current is directed from the power source to each motor, and a third electrical current is directed from the power source to the battery module; and in the charge-only mode, the third electrical current is directed from the power source to the battery module.

4. The powertrain of claim 1, wherein the second power capacity is equal to at least a difference between the peak power demand of the pumping operation and an average power demand of the pumping operation, and the first power capacity is equal to at least the average power demand of the pumping operation.

5. The powertrain of claim 1, wherein the power source comprises at least one prime mover operatively coupled to at least one generator.

6. The powertrain of claim 5, wherein the at least one prime mover comprises at least one turbine.

7. The powertrain of claim 1, wherein the power management system directs electrical current further based on a fuel efficiency of the power source.

8. A powertrain for a wellbore pumping operation, comprising:

a battery module comprising at least one battery;

at least one electric motor coupled to at least one pump; and a power management system electrically coupled to the battery module and the at least one motor, and configured to direct electrical current from the battery module to each motor; and a power source electrically connected to the power management system, wherein the power management system is further configured to selectably direct electrical current from the power source to the at least one battery of the battery module.

9. The powertrain of claim 8, wherein the at least one battery comprises a plurality of battery packs, each of the plurality of battery packs interchangeable with a plurality of replacement battery packs.

10. A method of operating a powertrain for a wellbore pumping operation having at least one electrical motor, a power demand and a peak power demand, comprising:

directing electrical current from a power source that produces power to each motor to meet a portion of the power demand, and directing electrical current from a battery module comprising at least one battery to each motor to meet a balance of the power demand;

wherein the power source has a first power capacity and the battery module has a second power capacity, and wherein the first power capacity is less than the peak power demand; and wherein the at least one battery of the battery module is charged by electrical current from the power source.

11. The method of claim 10, further comprising:

determining a state of charge of the battery module of the powertrain; and directing electrical current from the power source to each motor and, based on the state of charge of the battery module, directing electrical current to the battery module and to each motor.

12. The method of claim 11, wherein the step of directing electrical current further comprises:

selecting, based on the power demand and the state of charge, an operating mode of the powertrain out of a hybrid mode and one or more non-hybrid modes; and wherein in the hybrid mode comprises:

directing a first electrical current from the power source to each motor, and, directing a second electrical current from the battery module to each motor.

13. The method of claim 12, wherein the hybrid mode is selected when the power demand exceeds the first power capacity and the state of charge is greater than zero.

14. The method of claim 12, wherein the step of selecting an operating mode further comprises selecting an operating mode that enables the power source to operate at about a peak fuel efficiency.

15. The method of claim 12, wherein the one or more non-hybrid modes comprise at least an electric-only mode, a turbine-only mode, a charge-pump mode, and a charge-only mode; wherein in the non-hybrid modes:

in the electric-only mode, directing the second electrical current from the battery module to each motor;

in the turbine-only mode, directing the first electrical current from the power source to each motor;

in the charge-pump mode, directing the first electrical current from the power source to each motor, and directing a third electrical current from the power source to the battery module to charge the battery module; and in the charge-only mode, directing the third electrical current from the power source to the battery module.

16. The method of claim 15, wherein the turbine-only mode is selected when the power demand is equal to or less than the first power capacity and the state of charge is above an upper threshold.

17. The method of claim 15, wherein the charge-pump mode is selected when the power demand is less than the first power capacity and the stage of charge is below 100%.

18. The method of claim 15, wherein the electric-only mode is selected when the power demand is equal to or less than the second power capacity and the state of charge is above zero.

19. The method of claim 15, wherein the charge-only mode is selected when the power demand is zero and the state of charge is below 100%.

* * * * *